US006926521B2

(12) United States Patent
Meyer et al.

(10) Patent No.: US 6,926,521 B2
(45) Date of Patent: Aug. 9, 2005

(54) METHOD AND DEVICE FOR TREATING BULK PRODUCTS

(75) Inventors: Hartmut Meyer, Thomasburg (DE); Thomas Staak, Hamburg (DE)

(73) Assignee: Claudius Peters Technologies GmbH, Buxtehude (DE)

( * ) Notice: Subject to any disclaimer, the term of this patent is extended or adjusted under 35 U.S.C. 154(b) by 56 days.

(21) Appl. No.: 10/472,722

(22) PCT Filed: Mar. 19, 2002

(86) PCT No.: PCT/EP02/03042

§ 371 (c)(1),
(2), (4) Date: Sep. 18, 2003

(87) PCT Pub. No.: WO02/075230

PCT Pub. Date: Sep. 26, 2002

(65) Prior Publication Data

US 2004/0115581 A1 Jun. 17, 2004

(30) Foreign Application Priority Data

Mar. 20, 2001 (DE) ..... 101 13 516

(51) Int. Cl.[7] ..... F27D 15/02
(52) U.S. Cl. ..... 432/78; 432/137; 110/281
(58) Field of Search ..... 432/77, 78, 126, 432/137; 110/281, 282, 283, 284

(56) References Cited

U.S. PATENT DOCUMENTS 4,471,704 A * 9/1984 John et al. ..... 110/281
4,884,516 A * 12/1989 Linsen ..... 110/281
4,901,653 A * 2/1990 Baltzinger ..... 110/281
5,245,983 A * 9/1993 Krieger ..... 126/163 R
5,271,339 A * 12/1993 Yamagishi et al. ..... 110/281
5,549,471 A * 8/1996 Tegtmeier et al. ..... 432/77
5,715,687 A * 2/1998 Nienaber et al. ..... 62/57
5,890,888 A * 4/1999 Enkegaard ..... 432/77
5,947,719 A * 9/1999 Heinemann et al. ..... 432/78

FOREIGN PATENT DOCUMENTS

| | | |
|---|---|---|
| DE | 1 254 071 | 9/1964 |
| DE | 1 953 415 | 10/1969 |
| DE | 3421 432 A1 | 6/1984 |
| DE | 3734043 A | 4/1989 |
| DE | 196 49 921 A1 | 12/1996 |
| EP | 0 056 016 | 7/1982 |
| EP | 0 811 818 A1 | 5/1997 |
| FR | 2 528 806 | 12/1983 |
| GB | 2 077 243 | 12/1981 |
| GB | 2 183 617 | 6/1987 |

OTHER PUBLICATIONS

International Application No. WO 00/31483 Publication Date: Jun. 2, 2000.
European Patent Application No. EP 0 718 578 A2 Publication Date: Jun. 26, 1996.

* cited by examiner

*Primary Examiner*—Gregory Wilson
(74) *Attorney, Agent, or Firm*—Alix, Yale & Ristas, LLP

(57) ABSTRACT

Method and apparatus for treating, in particular cooling, bulk material which is lying on a conveying grate (10) in the form of a layer (20). The gas is passed through the grate (10) and the layer (20) from the bottom upward. The grate is moved forward and back in its entirety, with the layer of material (20) being held in place during the return stroke. The stroke frequency is selected to be sufficiently low for there to be substantially no vertical mixing of the layer of material (20). A blocking plate (30) or the like is provided for the purpose of holding the layer (20) in place. The avoidance of the vertical relative movement within the layer of material (20) improves the heat recovery.

37 Claims, 5 Drawing Sheets

Fig. 6
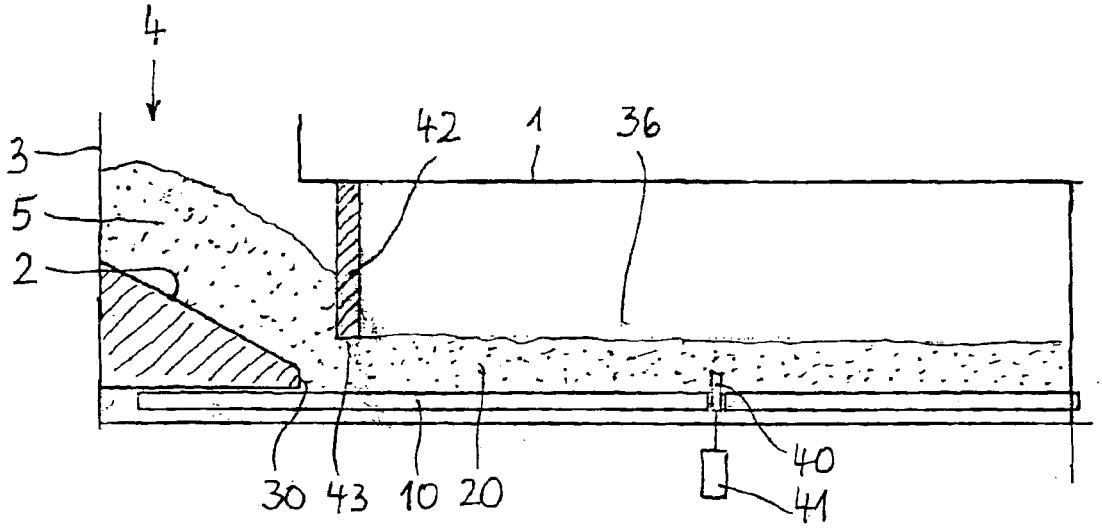
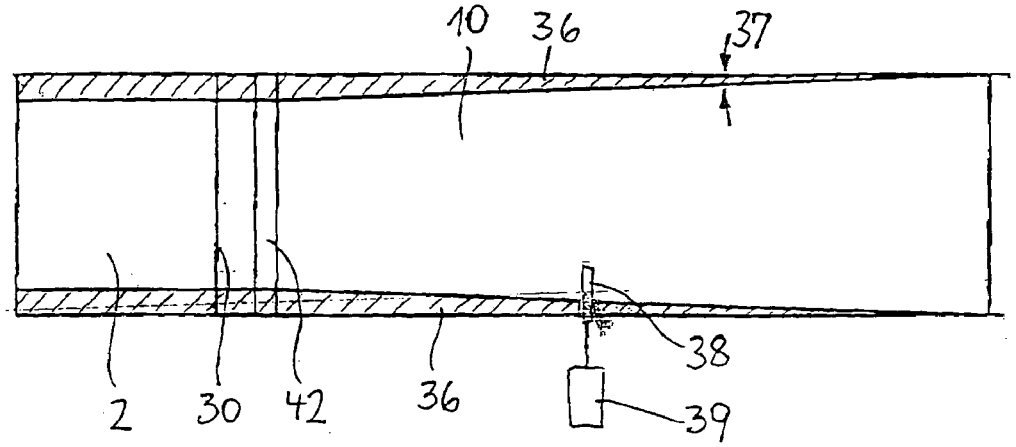
Fig. 7

METHOD AND DEVICE FOR TREATING BULK PRODUCTS

BACKGROUND OF THE INVENTION

It is known to treat bulk material with gas by conveying it continuously in a layer over a grate, with gas flowing through it in the process. What are known as reciprocating grates, which comprise overlapping rows of, alternately, stationary grate plates and grate plates which move forward and back in the conveying direction (DE-A-37 34 043, DE-A-196 49 921), are predominantly used for the cooling of combustion material, for example cement clinker. Cooling air which effects the cooling and is discharged above the layer of material in order for the heat to be recovered is blown into the bed of material through the grate plates. Another known design of grate makes use of a stationary air-permeable bearing floor over which the layer of material is moved by means of scrapers which move continuously in the conveying direction or reciprocating members (EP-A-718 578, WO 00/31483). Yet another type of cooler uses a migrating grate which moves continuously in an endless loop (DE-A 1 953 415). In all cases, it is endeavored to recover the heat transferred from the material being cooled to the cooling gas as completely as possible. Irrespective of the type of cooler, the recovery of heat has reached a relatively advanced state.

SUMMARY OF THE INVENTION

Surprisingly, it has proven possible to increase the recovery of heat further by using a new and improved method for operating a cooling grate or a new and improved cooling grate. In this case, there is provision for use of a conveying grate which is moved forward and back in its entirety and has a length of at least several meters, wherein the layer of material is held in place during the return stroke, so that the conveying location slides back beneath the layer of material which has been held in place. The stroke frequency is selected to be very low compared to reciprocating grates, namely, less than 20 per minute. This results in the effect that there is substantially no vertical mixing of the layer of material. During the return stroke of the grate, the layer of material is held in place by a blocking device, which the layer of material runs into during the return stroke, and which is arranged at the feed end in the region of the layer of material. The gap which is formed between the blocking device and the layer of material during the advancing stroke is always immediately filled from the stockpile of material located at the feed end. The low level of internal movement of the material is based on a relative movement taking place substantially only between the bed of material and the bearing plate, and even then only during the return stroke of the bearing plate.

The improvement in the heat recovery is based on the reduced vertical mixing of the bed of material. When gas flows from the bottom upward, the material located at the bottom of the layer of material is cooled first, while the material located further up remains at a high temperature. Therefore, the gas leaves the layer of material after it has ultimately been in contact with the layer which is at the highest temperature and has adopted the temperature of the latter. By contrast, in the known designs of cooler, the conveying movement ensures that the material being cooled adopts a mean temperature as a result of it being vertically mixed. Therefore, the gas leaves the layer of material at a correspondingly lower temperature.

The same is true if the method is not used for heat exchange, but rather for mass transfer, for example for drying, or if the gas is not guided through the layer of material from the bottom upward, but rather in the reverse direction.

The conveying principle which is to be used in accordance with the invention is known in the case of what are known as reciprocating feeders. These are conveyors which are used primarily for the metered feeding of bulk material out of containers (DE-B-12 54 071). There was no reason to suspect that the application of this principle would lead to benefits in heat exchange or mass transfer. On the contrary, the absence or very slight mixing of the bed of material was considered to be a drawback, since this opens up the possibility of the bed of material acquiring some internal cohesion, placing the uniform discharge of the material from the end of the conveyor in doubt (DE-A-34 21 432). In the context of the invention, this alleged drawback proves to be advantageous, since the cohesion of the layer makes it more difficult for part of the layer to break out under the blocking force which is active during the return stroke, thereby allowing a greater length of bearing plate to be used.

Since the stroke is not limited by the dimensions of the grate plates, as in the case of reciprocating grates, it may be made significantly greater than is customary with reciprocating grates. This increases the conveying efficiency combined, at the same time, with a reduced number of strokes if appropriate, the number of strokes being less than 20, more preferably less than 15 and preferably on average less than 10 $min^{-1}$. The number of strokes is generally about half that of reciprocating grates.

The feature whereby the stroke frequency is selected to be sufficiently low for there to be substantially no vertical mixing of the layer of material delimits the invention from known methods in which the floor which bears the layer of material is moved (vibrated) so quickly and if appropriate also with a vertical component that as a result the material is also made to vibrate, promoting vertical relative movement of the particles. Rather, the layer of material should rest on the grate during the advancing stroke and substantially also during the return stroke.

The invention does not require that there should be no vertical mixing of the layer of material whatsoever. However, it is easy to see that when the abovementioned conveying principle, is employed, the internal mixing of the layer of material is significantly lower than with the conveying principles which have previously been used for cooling grates.

The return stroke velocity is expediently greater than the advancing stroke velocity, since only the advancing stroke is responsible for effective conveying. The use of a return stroke acceleration which is greater than the advancing stroke acceleration may be an important feature. This is because the greater the return stroke acceleration, the more easily the adhesion between the bearing plate and the bed of material is released and therefore the lower the blocking force which has to be applied at the feed end of the layer of material to hold the latter in place. However, the return stroke acceleration should generally always remain below the adhesion release acceleration, since otherwise there is a risk of the layer of material being loosened and internally mixed by sudden movements. The adhesion release acceleration is the acceleration at which the force required for the return acceleration of the layer of material becomes greater than the static friction, and accordingly the layer no longer follows the return movement. Nevertheless, the mass effect can contribute to releasing the adhesion between material and bearing plate during the return stroke. By way of example, it may be expedient for the return stroke acceleration to be increased to over one third of the adhesion release acceleration.

The treatment gas is expediently allowed to flow through the grate and the layer of material from the bottom upward, since this facilitates the adhesion release. On the one hand, the bearing force of the bed of material is reduced in accordance with the pressure difference of the gas stream. On the other hand, the gas stream can effect a certain loosening of the boundary layer when it passes out of the bearing plate into the bed of material. Since it is desirable to facilitate adhesion release during the return acceleration phase, it may be advantageous for the velocity or pressure of the treatment gas to be kept at a higher level during the return acceleration and/or during the entire return stroke than during the advancing stroke.

It is possible to provide the bearing plate with side walls which move with it. If this increases the friction of the material during the return stroke to an undesirable level, such walls can be omitted.

The bearing plate is expediently sealed off from the housing at the sides, in order to substantially prevent fine material from dropping through. A seal of this type is also important in particular if the treatment air is forced at excessive pressure out of stationary chambers beneath the grate into the openings in the grate, which is open at the bottom, so that as little gas loss as possible occurs at the side edges of the grate.

Corresponding considerations also apply to the sealing of the bearing plate at its feed end or discharge end. The feed-side seal is expediently formed by a sealing plate which overlaps the bearing plate and is pressed onto the top side of the latter. The fact that the sealing plate slides on the top side of the bearing plate substantially without gaps means that the passage of gas at this point is prevented or kept at a low level. The sealing plate can be pressed onto the top side of the bearing plate by a resilient force, in particular a spring. If a small gap can be tolerated as an alternative to the complete absence of a gap, it is also possible for the sealing plate to be mounted in a fixed position a short distance above the bearing plate. Since high temperatures prevail at the feed end, it is expedient to make not just the bearing plate but also the sealing plate air-permeable and to apply a gas stream to it.

Compared to the grate plates of a reciprocating grate cooler, a bearing plate has a very great length, namely at least several meters. The entire cooling grate may be formed by a single bearing plate. If there are reasons to limit the length of a bearing plate (for example to the order of magnitude of 5 to 10 m) but a greater overall length of the grate is required, it is possible for a plurality of bearing plates to be arranged in succession, these bearing plates either interacting with a common blocking device at the feed end or each being provided with a dedicated blocking device.

The bearing plate is normally arranged approximately horizontally. Depending on the conveying conditions, in particular the flow and friction properties of the material, it is also possible to select an arrangement which rises slightly or drops slightly in the conveying direction.

One advantage of the invention consists in the fact that, on account of the reduced movement of material, less dust is produced and guided into the furnace with the secondary air than in the case of known coolers. As a result, firstly the furnace can be operated more efficiently, since the heat transfer between flame and combustion material is not reduced by dust, and secondly the outlay involved in dedusting the outgoing air is also reduced.

A further advantage of the invention consists in the fact that the entire bearing surface area is available for the supply of cooling air and cooling purposes, while in the case of reciprocating grate coolers and reciprocating bar coolers, some parts of the area cannot have cooling air supplied to them for design reasons.

A further advantage of the invention consists in the fact that the layer height is not subject to the limits which have to be observed in conventional coolers. A greater layer thickness promotes the recovery of heat.

Finally, another advantage of the invention is that, on account of the lack of internal movement of the material, there is less likelihood of liquid-like states being formed in some of the material. In known coolers, this phenomenon is feared because it leads to a flow of fine material which is in a liquid-like state shooting straight through a significant part of the length of the cooler virtually without being cooled. Since the discharge of the material from a rotary tubular kiln is associated with grain size separation, this phenomenon primarily occurs on that side of the cooler at which a higher proportion of fine grains is likely on account of this separation.

Furthermore, the grate which is used in accordance with the invention opens up the possibility of taking passive or active precautions to prevent the occurrence of this undesirable movement of free-flowing material. Passive precautions comprise means which inhibit the movement of the material on the grate in the conveying direction, for example projections which protrude from the bearing plate. In particular projections which extend primarily transversely with respect to the conveying direction, in the form of walls or strips or the like, are suitable. Since the abovementioned flow of material occurs predominantly in the edge region of the grate, flow obstacles of this type can also project from the side wall into the bed of material. Flow obstacles which project from an unmoving side wall can be used in particular if they are arranged above the normal layer height and therefore prevent a flow of material from shooting straight through when this occurs on the surface of the layer which is already resting on the bearing plate.

Active precautions may be formed by flow obstacles which are moved out of the bearing plate or the moving or unmoving side wall, from an inactive position, into the region of the material flow which is to be prevented, into an active position, as circumstances demand and can then be retracted again. They may also constantly project to a greater or lesser extent into the layer, with the distance of engagement, i.e. their height or length, being controlled as a function of the prevailing state of the bed.

It is known to use scanners to measure the surface temperature of the bed and to determine its temperature profile. If a rapid, hot flow of material occurs in or on the bed, this can be detected from the temperature profile. When such a phenomenon is detected, the flow obstacle or obstacles can be controlled accordingly.

It is also possible for the flow obstacle or obstacles to project into the layer only in working phases in which the layer is to move together with the bearing plate, i.e. during the advancing stroke, whereas they are completely or partially retracted as the bearing plate moves back.

If a flow obstacle is only to be active in the upper region of the layer of material, it can also be lowered onto or into the layer from above.

The flow resistance is greater in those regions of the width of the layer in which the layer contains a higher proportion of fine grains than in coarse-grained regions. According to the invention, this can be compensated for by the cooler being operated with a reduced layer thickness in the fine-grained regions of the width. For this purpose, the bearing plate can be arranged at a slightly higher level in these regions than in the coarse-grained regions. Since the fine-grained regions generally lie at the edge, the result is an inclination from the side occupied by finer grains toward the center in terms of the transverse profile of the bearing plate. If, on account of the separation of the material in the feed region of the cooler, it is likely that there will be a relatively high level of fine material at both edges of the grate, the bearing plate height is allowed to decrease from both sides toward the center, in a V shape. If the proportion of fine material occurs only or predominantly at one of the two edges, a correspondingly asymmetric inclination will suffice.

The feature whereby the conveying grate is moved forward and back in its entirety expresses the difference from reciprocating grates. However, it is not intended to rule out the possibility of the grate which is configured in accordance with the invention being only part of a larger grate installation, in which case this feature relates only to this part.

Reliable conveying operation is dependent on the bed of material being entrained by the bearing plate during its advancing stroke and the bearing plate sliding beneath the bed of material during the return stroke. The carrying-along of the bed of material during the advancing stroke is brought about by the friction between the bed of material and bearing plate. The sliding of the bearing plate relative to the bed of material during the return stroke is dependent on the frictional resistance between the bed of material and the bearing plate being overcome by forces acting in the opposite way. These oppositely acting forces include primarily the blocking resistance exerted by the blocking device arranged in the region of the layer of material at the feed end. It may be expedient to provide further devices which likewise impart a resistance to the layer of material when the bearing plate is moving back or which during this movement phase reduce the frictional resistance between the bed of material and the bearing plate. In particular, it is possible to provide a device for increasing the gas pressure acting on the bed of material in the bearing plate or from the underside during the return stroke compared to the advancing stroke. The friction-generating force with which the bed of material rests on the bearing plate is then reduced as a function of the pressure difference during the return stroke. Moreover, a powerful application of gas during the return stroke reduces the coefficient of friction between the material and the bearing plate.

Furthermore, the invention provides the option of providing members which are connected to the bearing plate and engage in the bed of material to a lesser extent (or preferably do not do so at all) during the return stroke and to a greater extent during the advancing stroke. The movement resistance to which the bed of material is subject during the return stroke can also be increased by the bearing plate being provided with side walls which delimit the bed of material and the clear distance between which increases in the conveying direction or narrows in the opposite direction. If these side walls are connected to the bearing plate, they reduce the frictional resistance between the bed of material and the walls during the return stroke of the bearing plate.

It is also possible to provide devices which increase the frictional resistance between the bed of material and stationary parts of the apparatus during the return stroke compared to the advancing stroke. These devices include holding members which are connected to the stationary structure of the apparatus and engage in the bed of material to a greater extent during the return stroke and to a lesser extent (or preferably do not do so at all) during the advancing stroke. It is also possible to provide a stationary pair of side walls which delimit the bed of material and the clear distance between which increases in the conveying direction. Should the bed of material have the tendency to move with the bearing plate during the return stroke, the increasing narrowing produced by the side walls would lead to an increased frictional resistance. Finally, it is possible to provide stationary devices which are located inside the bed of material and preferably impart a lower resistance to the movement of material in the conveying direction than to the movement in the opposite direction.

If the material is fed to the apparatus unevenly over the course of time, as is the case, for example, in coolers for combustion material to which the material is supplied from a combustion furnace, it is possible that a different layer height may be established on the bearing plate. This can be counteracted by varying the conveying rate (stroke frequency, stroke amplitude). As an alternative or in addition, the invention provides the possibility of using a layer-height limiter. This is a wall which is arranged at the start of the conveyor above the bearing plate and the bottom edge of which is at a distance from the bearing plate which corresponds to the desired thickness of the bed of material.

BRIEF DESCRIPTION OF THE DRAWINGS

The invention is explained in more detail below with reference to the drawing, which illustrates advantageous exemplary embodiments and in which:

FIG. 6 shows a diagrammatic longitudinal-vertical section, FIG. 7 shows a diagrammatic horizontal section.

Figures 1, 3, 4:
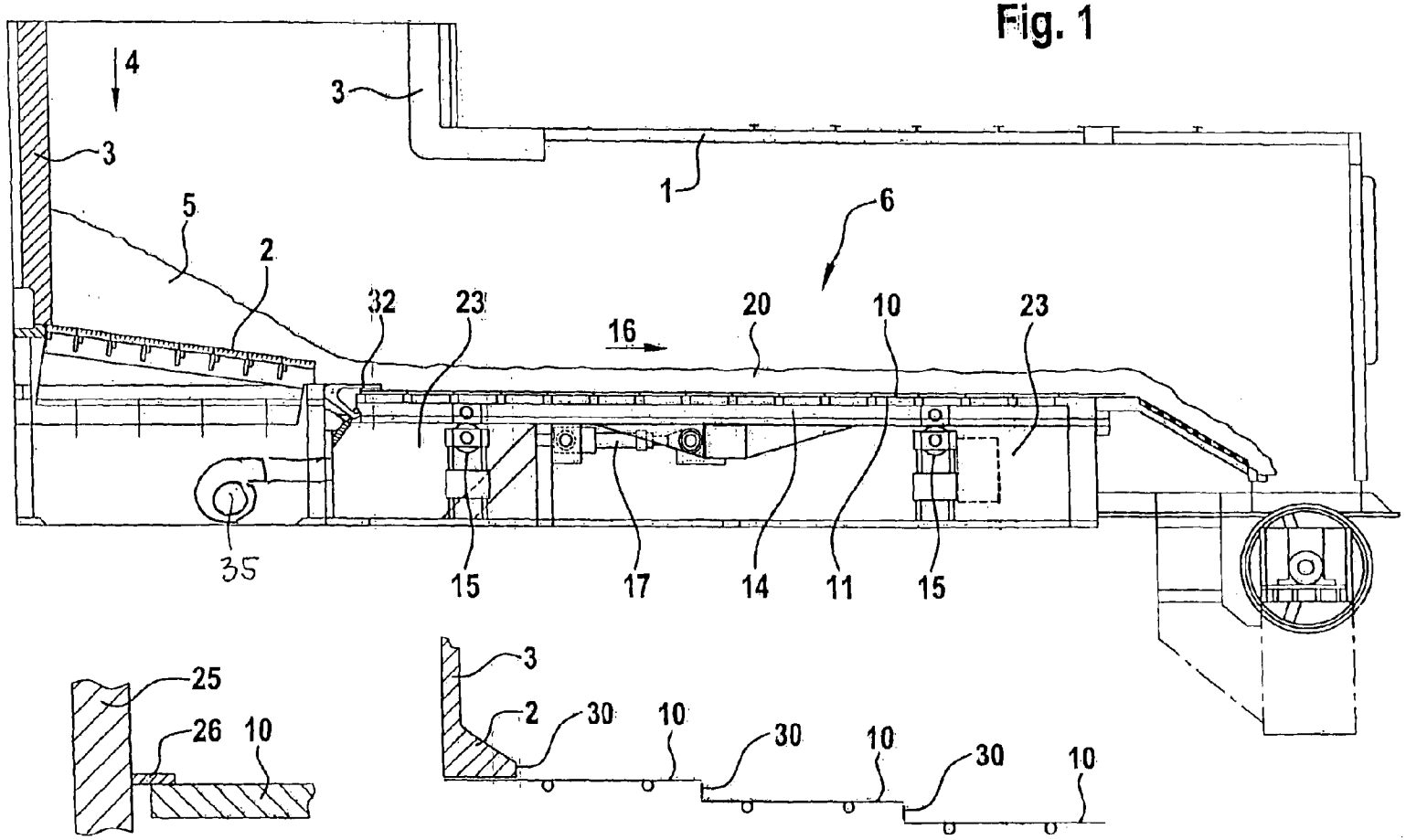
FIG. 1 shows a diagrammatic side view.
FIG. 3 shows a partial section through the side seal.
FIG. 4 shows an embodiment with a plurality of bearing plates connected in series.
Figure 2:
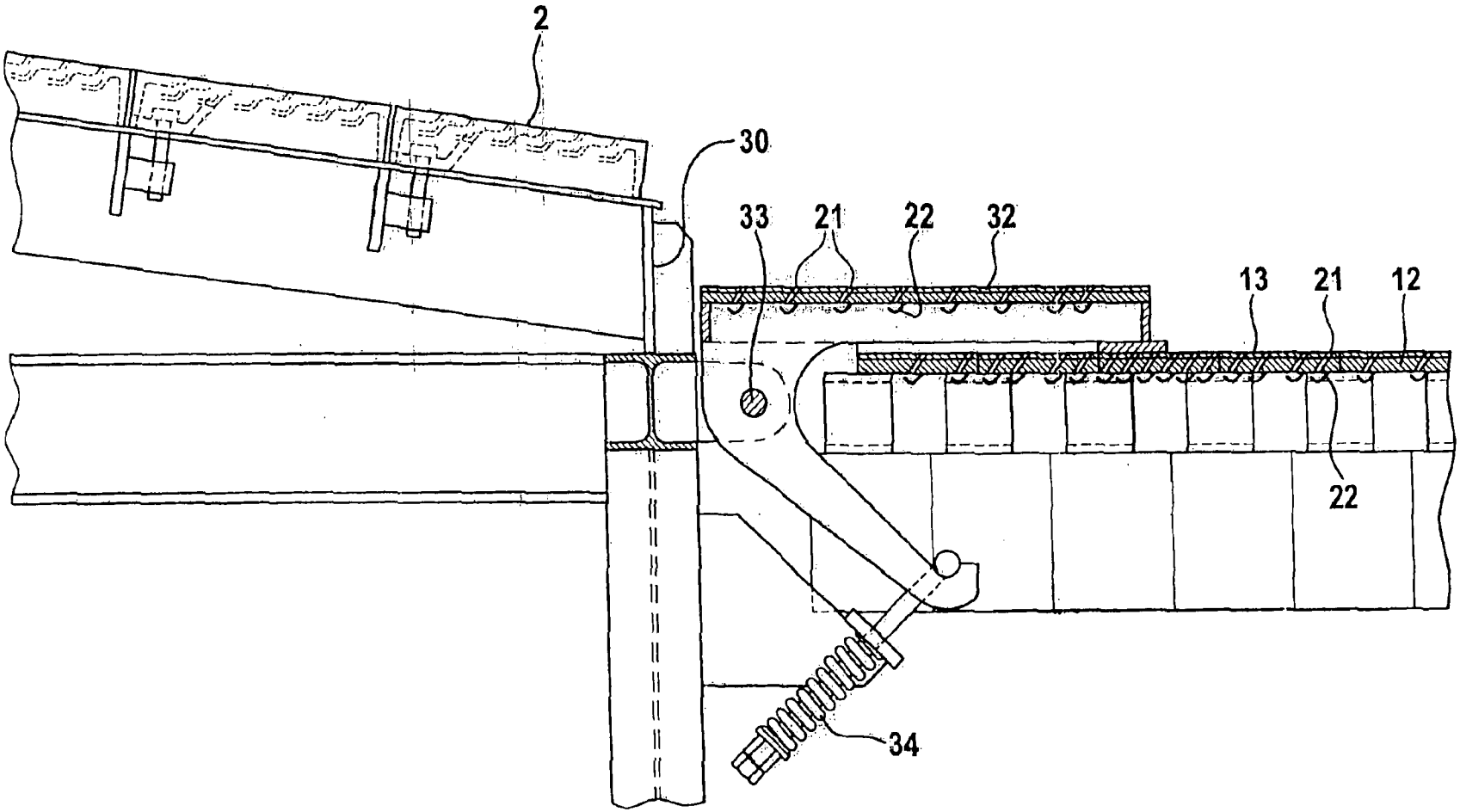
FIG. 2 shows a partial view on a larger scale.

The cooler for combustion material, e.g. cement clinker, arranged in a housing 1 comprises a section 6 which is designed in accordance with the invention. In the situation illustrated, there is an entry section located upstream of the section 6 and beneath the shaft, which is indicated by its walls 3 and in which the material coming out of the furnace is discharged in the direction indicated by arrow 4. It passes onto a sloping heap 5 which is formed on the preferably inclined surface 2 of the entry section. The surface 2 may be of conventional design, e.g. may comprise stationary or partially moving grate plates acted on by cooling air. It is possible to provide devices for mechanically loosening the material which prevent the material from caking together or break up relatively large pieces. The inclination of the surface 2 is expediently selected in such a way that on the one hand cool material remains lying on it, protecting it from the direct influence of the hot material arriving from the furnace, and that on the other hand relatively large pieces of the material move onward on account of its gradient.

As an alternative to the inclined surface 2, it is possible to provide devices of different design for receiving and moving onward the material discharged from the furnace, as are known, for example, upstream of reciprocating grate coolers in the prior art. They may also be dispensed with entirely, i.e. the cooler section 6 may extend back into the discharge region 4. This is readily possible since, on account of its conveying principle, it is never completely emptied and therefore a protective layer of material is located on it in any operating state, even when starting up from a shutdown.

DETAILED DESCRIPTION OF THE PREFERRED EMBODIMENTS

The cooler section 6 is formed primarily by a bearing plate 10. This comprises, for example, a framework 11 with sheet-metal plates 12 placed on top of it, adjacent to one another, which may be covered with a hard layer 13 to protect against wear. The bearing plate rests on a vibrating frame 14 which is mounted on rolls 15 in such a manner that it can move in the conveying direction 16. A hydraulic drive 17 imparts a reciprocating motion to it, preferably with an amplitude of 10 to 80 cm, more preferably from 30 to 50 cm, and a frequency of normally 5 to 10 $min^{-1}$, which is expediently controlled as a function of the thickness of the bed of material 20 located on the bearing plate 10 and may increase to, for example, 30 $min^{-1}$ in the event of an unusually high rate of production of material. The layer thickness of the material is, for example, 50 to 200 cm.

The sheet-metal plates 12 of the bearing plate 10 include uniformly distributed air passage slots 21 which can be configured in accordance with the principles which are known from grate plates (cf. for example EP-A-811 818). They may be provided with pockets 22 for collecting the fine material which drops through when the air stream is switched off, this material being entrained by the air stream when its operation subsequently resumes and thereby returned to the layer of material.

In the example illustrated, it has been assumed that the chambers 23 beneath the bearing plate 10 are acted on with excessive pressure by a blower 35, so that an air stream which is directed from the bottom upward through the openings 21 is produced. However, the bearing plate 10 may also be formed as a covering plate for a closed box, in which case the cooling air is supplied to the interior of the box through flexible hoses or the like. As is known from reciprocating grates, it is possible for individual sections of the bearing plate 10 to be separated and if appropriate acted on by different pressures.

The side edges of the bearing plate 10 are sealed off from the adjoining housing wall 25 as shown in FIG. 3 by a seal 26, which is not shown in more detail. This prevents fine material from dropping through and if appropriate also prevents the passage of cooling air.

At the feed-side end of the bearing plate 10, a blocking plate 30 is arranged in the region of the height of the layer of material 20. It may be provided just before the bearing plate or above the latter. During its advancing stroke, the bearing plate carries the material resting on it along with it. This leads to the formation of a gap in the layer of material 20 at the bottom of the sloping heap 5, and this gap is immediately filled with the material which then flows down from the sloping heap 5. During the return stroke, the layer of material 20 initially still sticks to the bearing plate until it comes into contact with the blocking plate 30. As soon as the blocking force exceeds the frictional force between layer of material 20 and bearing plate 10, the layer of material remains in place while the bearing plate 10 continues to move back beneath it. The blocking device does not necessarily have to be in the form of a plate for it to be able to fulfill this function. It is also not necessary for the blocking device to be located directly at the feed end of the bearing plate, although this is advantageous. Rather, the blocking pressure can also be transmitted through the sloping heap 5 as it runs down to the level of the bearing plate to a force-absorbing surface located at a distance further from the bearing plate 10. This force-absorbing surface may, for example, be formed by the surface 2 or wall 3, which are then correspondingly deepened.

To seal off the moving feed end of the bearing plate 10 from the stationary components, there is a sealing plate 32, of which the end facing in the conveying direction 16 rests on the top side of the bearing plate 10. The other end of the sealing plate 32 is pivotably mounted at 33 and is connected in a sealed manner to the blocking plate 30, in a manner which is not illustrated. A spring 34 presses the sealing plate 30 onto the bearing plate 10 substantially without any gap being left, via a lever arm.

The discharge-side end of the bearing plate 10 is expediently likewise sealed off with respect to the stationary devices, for example by a spring-steel strip, which bears against the underside of the bearing plate without leaving any gap and is not shown.

The fact that air is blown into the layer of material 20 from the bottom upward reduces the bearing pressure of the layer of material, on account of its oppositely directed pressure, and loosens this layer of material slightly in its bottom region. The friction between the layer of material and the bearing plate is therefore lower than in the case of reciprocating feeders, and the conveying length can be correspondingly greater. Furthermore, the reversing acceleration at the transition from the advancing stroke to the return stroke can be used to facilitate the release of the material adhering to the bearing plate.

Figure 5:
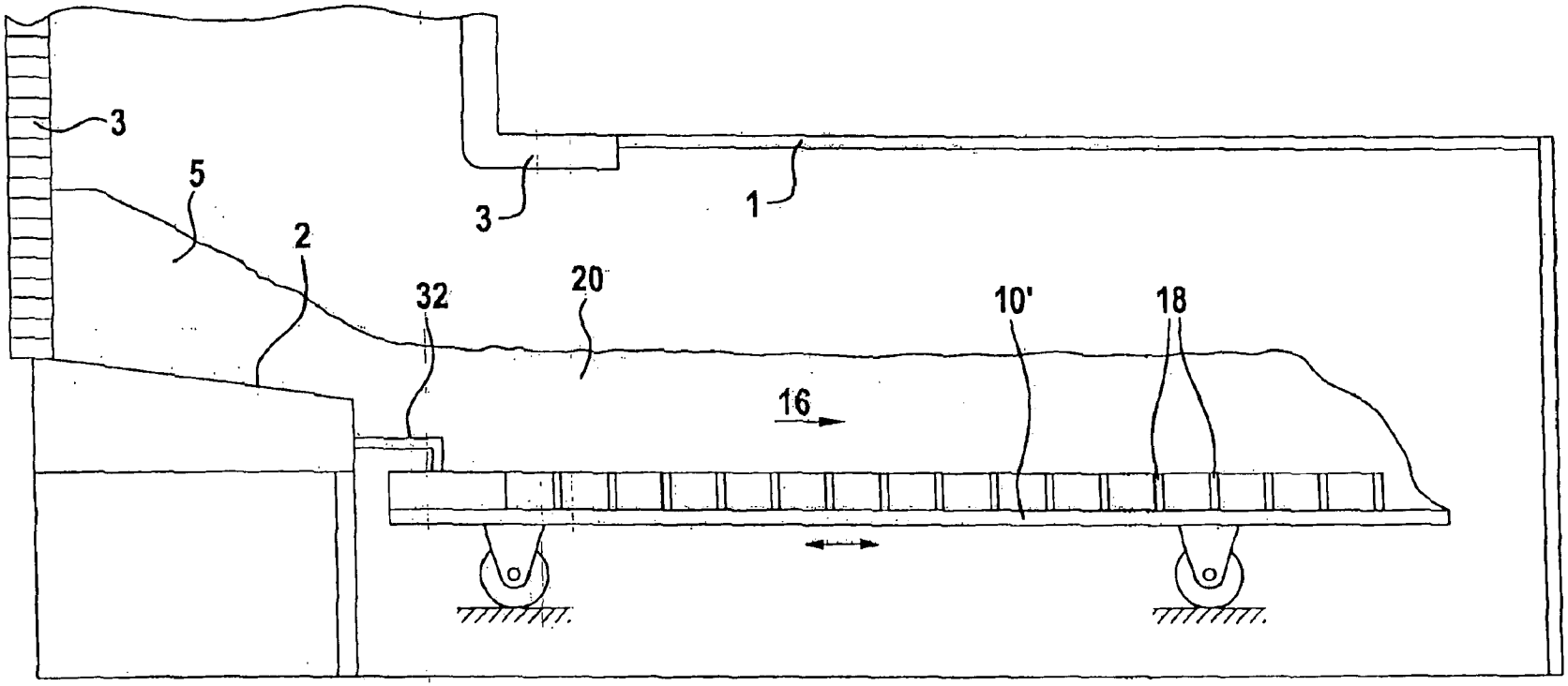
FIG. 5 shows a diagrammatic longitudinal section through a variant embodiment in which the bearing plate is provided with transverse ribs.

The surface of the bearing plate is expediently configured in such a way that the lowest possible friction is produced with respect to the material. However, particularly in the starting region of the bearing plate, it may be appropriate to select a surface shape which leads to cool material being held in place as a protective layer beneath the hot material located above it. By way of example, in accordance with FIG. 5 the bearing plate 10' is to this end provided with transverse ribs 18, the height of which is expediently between 5 and 15 cm and the distance between which in direction 16 is, for example, between 10 and 30 cm. This distance should not significantly exceed the advancing movement length and is preferably shorter than this length. The effect of the transverse ribs is to cause material to be held in place in the troughs which are formed between the ribs, protecting the bearing plate from the direct action of hot material and from wear. Devices of this type for holding a cool layer of material in place do not need to cover the entire surface of the bearing plate, but rather may be restricted to those regions in which otherwise it would be necessary to reckon with a particularly high load on the bearing plate. They may also be configured differently, should this be appropriate for holding the material in place.

If a very great cooler length is required, which cannot be managed with a single bearing plate length, it is possible for a plurality of bearing plates 10 or groups of such bearing plates, each with dedicated blocking devices 30, to be connected in series in accordance with the example shown in FIG. 4.

If the particles tend to stick together relatively strongly on account of the absence of any internal movement of the material, helping the bed of material to hold together in its immediate form, this phenomenon is advantageous in the context of the invention, since it reduces the risk of the bed of material yielding in the starting region of the bearing plate under the blocking pressure acting on it during the return stroke.

A significant advantage of the cooler according to the invention consists in the fact that the material is protected. It is therefore suitable even for sensitive material, such as for example expanded clay. Furthermore, it has the advantage that a uniform distribution of air can be achieved more easily than in grate designs in which internal movement of material takes place.

The supply of compressed air 35 to the chamber 23 is controlled in such a way that the pressure during the return stroke is greater than during the advancing stroke. This reduces the friction of the bed of material 20 against the bearing plate 20. Less energy is required to move the bearing plate back beneath the bed of material 20.

It is also possible to assist the retention of the bed of material with respect to the bearing plate moving back by the bed of material being laterally surrounded by stationary walls 36, the inner surfaces of which are inclined in opposite directions, by an angle 37, with respect to the direction of movement of the bearing plate 10, in such a manner that the distance between them widens out in the conveying direction. If the bed of material 20 tends to follow the bearing plate during the return movement, it is increasingly constricted by the inner surfaces of the walls 36, with the result that a retaining force is exerted on the bed of material 20 in addition to the blocking resistance of the end face 30. If the walls 36 are connected to the bearing plate and move with the latter, the walls increase the frictional resistance with the material during the advancing stroke.

Instead of or in addition to this inclination, it is also possible for retaining devices 38, only one of which is indicated in FIG. 7, to be provided in the walls 36 or in other stationary structures of the apparatus. These retaining devices are slides or flaps or the like which are controlled by means of a drive 39 in such a manner that during the return stroke of the bearing plate 10 they project into the bed of material 20 in order to hold it in place, whereas they are retracted during the advancing stroke of the bearing plate 10. Retaining devices of this type can also act on the bed of material 20 from above or from below through the bearing plate 10.

FIG. 6 indicates that a similar retaining device 40 with drive 41 is arranged in the bearing plate. It moves forward and back with the bearing plate. During the advancing stroke of the bearing plate, the retaining device 40 projects into the bed of material in order to carry it along with the bearing plate. During the return stroke of the bearing plate, this retaining device has been retracted from the bed of material in order not to impede the relative movement between the bed of material and bearing plate. A large number of the retaining devices 38, 40 may be distributed in a suitable way along the path of the bed of material.

Figure 8:
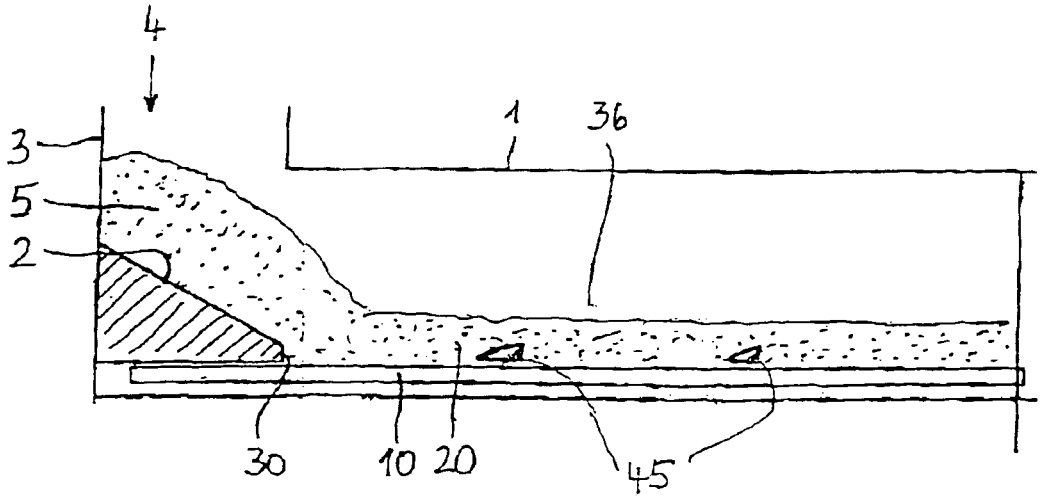
FIG. 8 shows a further variant embodiment in longitudinal section.

In accordance with FIG. 8, transversely running, stationary bars 45 are provided above the bearing plate 10, inhibiting a return movement of the bed of material together with the bearing plate 10 during the return stroke of the latter. The cross section of these bars is preferably selected in such a way that the extent to which they inhibit the movement of material is greater in the return direction than in the conveying direction. In the example illustrated, they are for this purpose triangular in shape, with their point facing in the opposite direction to the conveying direction, and they are arranged a short distance above the bearing plate 10.

FIG. 6 illustrates a layer-height limiter 42, which is arranged as a fixed or vertically adjustable wall in the cooler housing 1. Its lower edge 43 determines the maximum height of the bed of material 20. In front of the wall 42 in the conveying direction there is a buffer space in which the sloping heap 5 forms a buffer volume in the event of a temporarily increased production of material.

The distance between the wall 42 and the blocking plate 30 should be less than the height of the lower edge 43 of the wall 42 above the bearing plate 10.

What is claimed is:

1. A method for treating, in particular cooling, a layer of bulk material resting on a conveying grate by means of a gas stream passed through the grate and the layer of material, characterized in that the conveying grate, which is formed by a bearing plate with a length of at least several meters, is moved in a stroke forward and back in its entirety, the layer of material being held in place during the return stroke, so that the conveying grate slides back beneath the layer of material, and the stroke frequency being less than 20 $min^{-1}$, so that there is substantially no vertical mixing of the layer of material.

2. The method as claimed in claim 1, characterized in that the stroke frequency is less than 10 $min^{-1}$.

3. The method as claimed in claim 1, characterized in that the return stroke velocity is greater than the advancing stroke velocity.

4. The method as claimed in claim 1, characterized in that the return stroke acceleration is greater than the advancing stroke acceleration.

5. The method as claimed in claim 1, characterized in that the return stroke acceleration is lower than an adhesion release acceleration.

6. The method as claimed in claim 1, characterized in that the return stroke acceleration exceeds one third of an adhesion release acceleration.

7. The method as claimed in claim 1, characterized in that the gas stream is directed from the bottom upward.

8. A method for treating, in particular cooling, a layer of bulk material resting on a conveying grate by means of a gas stream passed through the grate and the layer of material, characterized in that the conveying grate, which is formed by a bearing plate with a length of at least several meters, is moved in a stroke forward and back in its entirety, the layer of material being held in place during the return stroke, so that the conveying grate slides back beneath the layer of material, and the stroke frequency being less than 20 $min^{-1}$, so that there is substantially no vertical mixing of the layer of material wherein the gas velocity or the pressure acting on the grate is higher during the return stroke acceleration than during the advancing stroke and wherein the return stroke acceleration exceeds one third of an adhesion release acceleration.

9. An apparatus for treating, in particular cooling, bulk material with a gas, which has a grate which conveys a layer of the bulk material from a feed end to a discharge end, has gas passage openings and is connected to means for generating a gas stream which passes through the grate and the layer of material, characterized in that the grate is formed by a bearing plate which is moved forward and back in the conveying direction in its entirety, has a length of several meters and at the feed end of which there is a device for blocking the layer of material during the return movement of the bearing plate and further characterized in that there are means for inhibiting the flow of material.

10. The apparatus as claimed in claim 9, characterized in that the blocking device is formed by a stationary blocking surface.

11. The apparatus as claimed in claim 9, characterized in that the bearing plate is sealed at the sides with respect to a housing.

12. The apparatus as claimed in claim 9, characterized in that the bearing plate is provided with side walls which move with it.

13. The apparatus as claimed in claim 9, characterized in that the bearing plate is free of side walls which move with it.

14. The apparatus as claimed in claim 9, characterized in that the bearing plate is sealed with respect to stationary components at the feed end and/or discharge end.

15. The apparatus as claimed in claim 14, wherein the bearing plate has a top side characterized in that the seal provided at the feed end is formed by a sealing plate which overlaps the bearing plate and is pressed resiliently onto the top side of the bearing plate.

16. The method as claimed in claim 15, characterized in that the sealing plate is air-permeable and has a gas stream acting on it.

17. The apparatus as claimed in claim 9, characterized in that the gas stream is directed from the bottom upward.

18. The apparatus as claimed in claim 9, characterized in that a plurality of bearing plates with a common blocking device are provided at the feed end.

19. The apparatus as claimed in claim 9, characterized in that a plurality of bearing plates or groups of bearing plates are arranged in succession, each having their own blocking device.

20. The apparatus as claimed in claim 9, wherein the layer of material forms a bed with an overall height characterized in that the bearing plate is equipped with devices for holding in place a layer of material which is thin in relation to the overall height of the bed of material.

21. The apparatus as claimed in claim 20, characterized in that the devices are formed by ribs and/or troughs.

22. The apparatus as claimed in claim 9, characterized in that the means for inhibiting the flow of material are provided in the edge region of the grate.

23. The apparatus as claimed in claim 9, characterized in that the means for inhibiting the flow of material are fixedly connected to the bearing plate.

24. The apparatus as claimed in claim 9, characterized in that the means for inhibiting the flow of material are moveable.

25. The apparatus as claimed in claim 24, wherein the layer of material forms a bed having a condition characterized in that there is a control device for moving the means for inhibiting the flow of material as a function of the condition of the bed of material.

26. The apparatus as claimed in claim 9, wherein the layer of material forms a bed and the grate has a return stroke and an advancing stroke characterized in that there are means for reducing the frictional resistance between the bed of material and the bearing plate during the return stroke compared to the advancing stroke.

27. The apparatus as claimed in claim 9, wherein the layer of material forms a bed characterized in that there are two side walls, which are stationary or moved together with the bearing plate, enclose the bed of material and the clear distance between which increases in the conveying direction.

28. The apparatus as claimed in claim 9, wherein the layer of material forms a bed and the grate has a return stroke and an advancing stroke characterized in that there are means for increasing the frictional resistance between the bed of material and stationary part of the apparatus during the return stroke compared to the advancing stroke.

29. The apparatus as claimed in claim 9, characterized in that a layer-height limiter is provided at the feed end.

30. An apparatus for treating, in particular cooling, bulk material with a gas, which has a grate which conveys a layer of the bulk material from a feed end to a discharge end, has gas passage openings and is connected to means for generating a gas stream which passes through the grate and the layer of material, characterized in that the grate is formed by a bearing plate which is moved forward and back in the conveying direction in its entirety, has a length of several meters and at the feed end of which there is a device for blocking the layer of material during the return movement of the bearing plate, wherein the layer of material forms a bed and the grate has a return stroke and an advancing stroke characterized in that there are means for reducing the frictional resistance between the bed of material and the bearing plate during the return stroke compared to the advancing stroke and further characterized in that there is a device for increasing the gas pressure acting in the bearing plate during the return stroke compared to the advancing stroke.

31. An apparatus for treating, in particular cooling, bulk material with a gas, which has a grate which conveys a layer of the bulk material from a feed end to a discharge end, has gas passage openings and is connected to means for generating a gas stream which passes through the grate and the layer of material, characterized in that the grate is formed by a bearing plate which is moved forward and back in the conveying direction in its entirety, has a length of several meters and at the feed end of which there is a device for blocking the layer of material during the return movement of the bearing plate, wherein the layer of material forms a bed and the grate has a return stroke and an advancing stroke characterized in that there are means for reducing the frictional resistance between the bed of material and the bearing plate during the return stroke compared to the advancing stroke and further characterized in that there are holding members which are connecting to the bearing plate and which engage in the bed of material to a lesser extent during the return stroke and to a greater extent during the advancing stroke.

32. An apparatus for treating, in particular cooling, bulk material with a gas, which has a grate which conveys a layer of the bulk material from a feed end to a discharge end, has gas passage openings and is connected to means for generating a gas stream which passes through the grate and the layer of material, characterized in that the grate is formed by a bearing plate which is moved forward and back in the conveying direction in its entirety, has a length of several meters and at the feed end of which there is a device for blocking the layer of material during the return movement of the bearing plate, wherein the layer of material forms a bed and the grate has a return stroke and an advancing stroke characterized in that there are means for increasing the frictional resistance between the bed of material and stationary part of the apparatus during the return stroke compared to the advancing stroke and further characterized in that there are holding members which are connected to the stationary structure of the apparatus and engage in the bed of material to a greater extent during the return stroke and to a lesser extent during the advancing stroke.

33. The apparatus as claimed in claim 32, characterized in that there is a pair of walls which laterally encloses the bed of material and the clear distance between which increases in the conveying direction.

34. A method for treating, in particular cooling, a layer of bulk material resting on a conveying grate by means of a gas stream passed through the grate and the layer of material, characterized in that the conveying grate, which is formed by a bearing plate with a length of at least several meters, is moved in a stroke forward and back in its entirety, the layer of material being held in place during the return stroke, so that the conveying grate slides back beneath the layer of material, and the stroke frequency being less than 20 $min^{-1}$, so that there is substantially no vertical mixing of the layer of material, wherein the layer of material forms a bed characterized in that at least one transverse bar is provided above the bearing plate, at a height which is lower than the height intended for the bed of material, at a distance from the feed end and the discharge end.

35. The apparatus as claimed in claim 34, characterized in that the bar imparts a lower resistance to flow of material in the conveying direction than in the opposite direction.

36. The apparatus as claimed in claim 34, characterized in that the bar is arranged closer to the bearing plate than to the height intended for the bed of material.

37. The apparatus as claimed in claim 34, characterized in that the at least one bar has a shallow triangular profile with its tip facing in the opposite direction to the conveying direction.

* * * * *